US008708733B2

(12) United States Patent
Parrish

(10) Patent No.: US 8,708,733 B2
(45) Date of Patent: Apr. 29, 2014

(54) LARGE DEFLECTION CONSTRAINED INSULATION DISPLACEMENT TERMINAL AND CONNECTOR

(75) Inventor: Jeffrey D. Parrish, Westland, MI (US)

(73) Assignee: Interplex Industries, Inc., College Point, NY (US)

( * ) Notice: Subject to any disclaimer, the term of this patent is extended or adjusted under 35 U.S.C. 154(b) by 3 days.

(21) Appl. No.: 13/591,611

(22) Filed: Aug. 22, 2012

(65) Prior Publication Data

US 2013/0065424 A1 Mar. 14, 2013

Related U.S. Application Data

(60) Provisional application No. 61/534,448, filed on Sep. 14, 2011.

(51) Int. Cl.
*H01R 4/24* (2006.01)

(52) U.S. Cl.
USPC ..... 439/395

(58) Field of Classification Search
USPC ..... 439/395
See application file for complete search history.

(56) References Cited

U.S. PATENT DOCUMENTS

| | | | | |
|---|---|---|---|---|
| 4,527,852 | A * | 7/1985 | Dechelette | 439/408 |
| 4,861,278 | A * | 8/1989 | McBride et al. | 439/395 |
| 4,955,816 | A | 9/1990 | Roberts et al. | |
| 5,030,132 | A | 7/1991 | Hayes et al. | |
| 5,564,941 | A | 10/1996 | Norden | |
| 5,685,733 | A * | 11/1997 | Janczak | 439/395 |
| 5,997,336 | A | 12/1999 | Yamamoto et al. | |
| 6,050,842 | A | 4/2000 | Ferrill et al. | |
| 6,979,222 | B2 * | 12/2005 | Comini | 439/404 |
| 7,118,404 | B2 * | 10/2006 | Ploesser | 439/398 |
| 2007/0190844 | A1 * | 8/2007 | Donhauser et al. | 439/395 |
| 2009/0073629 | A1 * | 3/2009 | Forgue | 361/215 |
| 2012/0058667 | A1 * | 3/2012 | Carreras Garcia et al. | 439/395 |

OTHER PUBLICATIONS

AMP Magnet Wire Terminals and Termination Systems, Catalog 82221, Oct. 2002.

* cited by examiner

*Primary Examiner* — Gary Paumen
(74) *Attorney, Agent, or Firm* — Preti Flaherty Beliveau & Pachios LLP

(57) ABSTRACT

An improved insulation displacement terminal (IDT) includes opposed spaced fingers having outer edges with first and second abutment sections adjacent the ends of the outer edges. A resilient spring-like mid-section in the finger between the abutment sections applies a generally normal force to a wire captured between the inner edges of opposed fingers of the IDT. The resilient spring-like mid-section of each finger may be provided by narrowing the width of each finger between the abutment sections such as by recessing the outer edges from the outer edges of the abutment sections or by providing slots or openings in the mid-section of the fingers. Corners of inner edges of the fingers are smoother and inner edges are generally planar to provide a large contact area between the fingers and a wire disposed therebetween. The IDT is mounted within a housing to provide an insulation displacement connector (IDC).

14 Claims, 8 Drawing Sheets

LARGE DEFLECTION CONSTRAINED INSULATION DISPLACEMENT TERMINAL AND CONNECTOR

CROSS REFERENCE TO RELATED APPLICATIONS

The present application is related to and claims priority benefit of U.S. Provisional Patent Application No. 61/534,448 entitled Large Deflection High Normal Force Constrained Insulation Displacement Terminal and filed Sep. 14, 2011.

STATEMENT REGARDING FEDERALLY SPONSORED RESEARCH OR DEVELOPMENT

—Not Applicable—

FIELD OF THE INVENTION

The present invention relates to insulation displacement connectors (IDC) and terminals employed therein.

BACKGROUND OF THE INVENTION

Insulation displacement connectors (IDCs) and insulation displacement terminals (IDTs) used therein are generally known. IDCs are employed in circumstances in which it is desirable to rapidly make a connection with an insulated wire. During the connection of the IDT to the wire, opposed fingers of the IDT are slidably disposed over the wire and displace or remove the insulating coating or cover on the wire to permit direct electrical contact between the conductive IDT and the conductive wire. IDTs employed within typical IDCs have outer edges that include a barb that engage end walls of a terminal receiving slot to secure the terminal within a connector housing. Opposed fingers of the IDT are typically rigid. Consequently, the distance between the inner edges of fingers that engage the wire can only accommodate a very narrow range of wire sizes.

As are result of the stamping operation employed in the manufacture of typical IDTs, the corners of inner edges of the fingers are sharp and the opposing inner edges are uneven. The sharpened corners of the inner edge cut into the wire during the installation of the wire in an IDC and the uneven inner edges result in varying forces being applied by the edges to the wire along the inner edges. The structure of such inner edges in conventional IDTs can result in intermittent or unreliable connections between the IDT and the wire over time.

Moreover, temperature cycling or variations with typical IDCs can result in a varying resistance between the IDT and a wire disposed within the IDT as the pressure applied to the wire by interior terminal edges varies. Consequently, in IDCs carrying large currents, significant increases in heat can result in circumstances in which the resistance between the terminal and the wire increases.

It would therefore be desirable to have an IDT and IDC that accommodates a wider range of wire sizes than conventional IDTs and that is less susceptible to problems associated with temperature and dimensional variations than are observed with conventional IDCs and IDTs.

BRIEF SUMMARY OF THE INVENTION

An improved insulation displacement terminal (IDT) and an insulation displacement connector (IDC) employing such a terminal is disclosed. The IDT includes a base portion, a contact member extending from the base portion in a first direction and a pair of spaced fingers extending from the base portion in a second direction opposite to the first direction. The spacing between the pair of fingers is slightly less than the diameter of a wire used with the IDT. Corners of inner edges of opposed fingers are smoothed, such as by a deburring and metal forming process to provide rounded or chamfered corners and a generally planar inner edge. This smoothing of the corners of inner edges may be performed in a secondary operation following the formation of the terminal blank. The generally planar inner edge makes contact over a larger area with a wire that is captured between the inner edges of the IDT than would be achieved with a terminal that was simply stamped and not deburred to remove sharpened corners on the inner edges and provide generally planar inner edges.

A connector housing includes a terminal receiving slot having an open end and a generally U-shaped wire receiving slot. An insulated wire is disposed in the wire receiving slot and the IDT is inserted within the terminal receiving slot in the housing. When inserted into the housing, a scraper formed along the inner edge of each finger of the IDT displaces the insulation on each side of the wire to expose a portion of the wire that makes conductive contact upon full insertion of the IDT into the terminal receiving slot.

The outer edges of the fingers have upper and lower abutment sections that abut end walls of the terminal receiving slot and are outwardly constrained by the end walls when the IDT is disposed within the terminal receiving slot. Between the upper and lower abutment sections, the fingers have a recessed outer edge. Consequently, the width of each finger is thinner in the mid-section between the first and second abutment sections. The resulting finger structure thus includes a resilient and spring-like beam extending between the first and second abutment sections. Following installation of the IDT within the housing, the spring-like mid-section applies a generally normal force to the wire.

Other features, advantages and aspects of the presently disclosed IDT and IDC will be apparent to those skilled in the art in view of the drawings and detailed description that follows.

BRIEF DESCRIPTION OF THE SEVERAL VIEWS OF THE DRAWINGS

The invention will be more fully understood by referenced to the following Detailed Description of the Invention in conjunction with the drawings of which.

DETAILED DESCRIPTION OF THE INVENTION

The entire disclosure of U.S. Provisional Patent Application No. 61/534,448 filed Sep. 14, 2011 and titled Large Deflection High Normal Force Constrained Insulation Displacement Terminal is hereby incorporated by reference.

A prior art insulation displacement connector (IDC) employing an insulation displacement terminal (IDT) is illustrated in FIG. 1*a*-1*d*. The IDT 100 includes fingers 102 of generally constant width along the length of the fingers. The fingers are relatively stiff and permit little outward deflection due to the finger 102 stiffness in a direction transverse to the length of the fingers. Consequently, at the point of engagement of fingers 102 with a wire 104 disposed therebetween the conventional IDT can only accommodate a very narrow range of wire sizes.

Figure 1A:
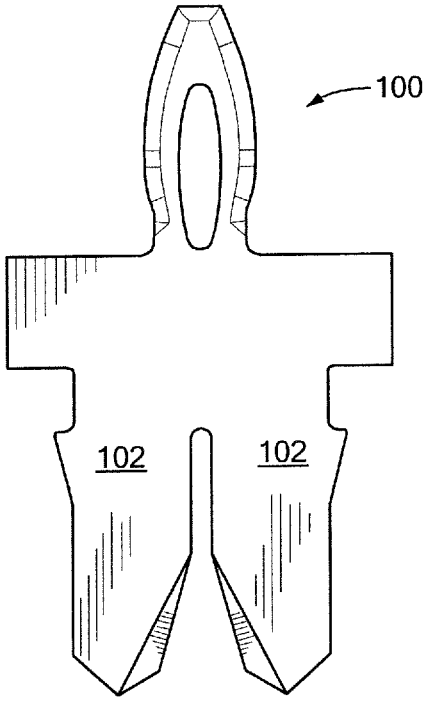
FIG. 1a PRIOR ART
FIG. 1*a* is a side view of a conventional insulation displacement terminal (IDT) for use in an insulation displacement connector (IDC)
Figure 1B:
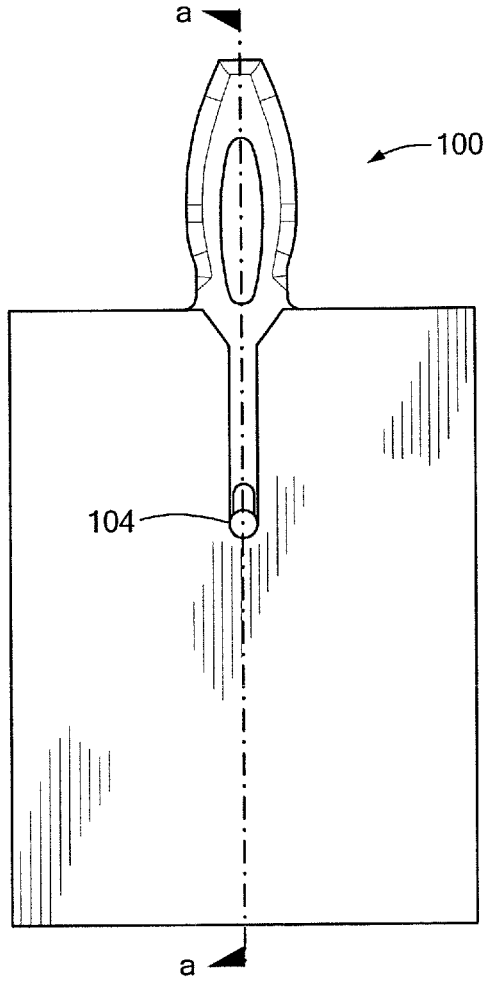
FIG. 1b PRIOR ART
FIG. 1*b* is a side view of a conventional IDC employing the IDT depicted in FIG. 1*a;*
Figure 1D:
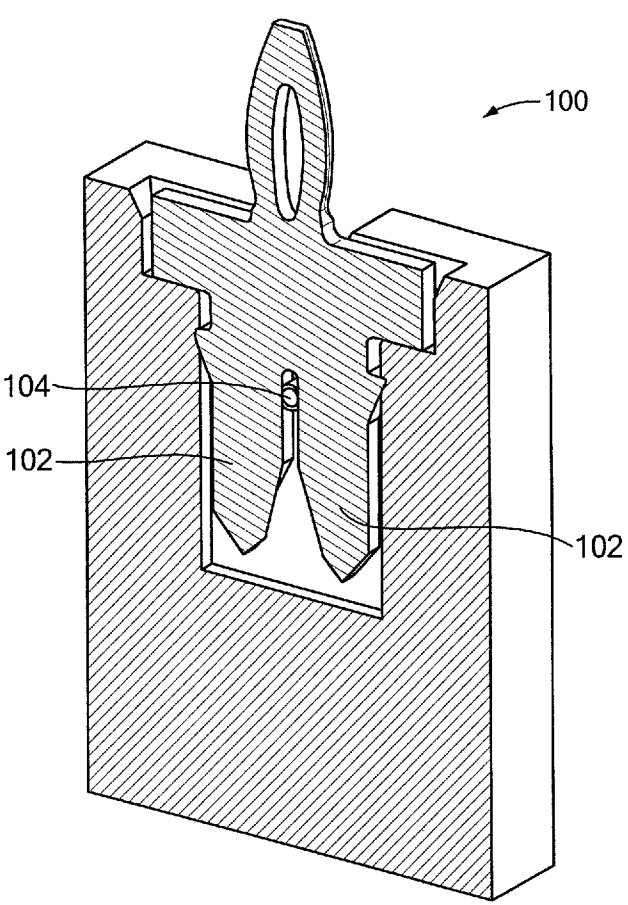
FIG. 1d PRIOR ART
FIG. 1*d* is a cutaway perspective view of the conventional IDC of FIGS. 1*b* and 1*c* employing the IDT of FIG. 1*a;*
Figure 1C:
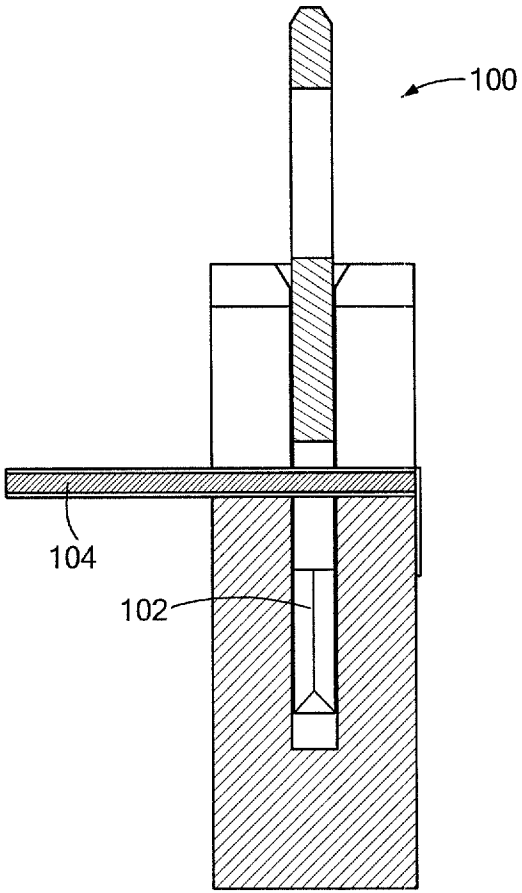
FIG. 1c PRIOR ART
FIG. 1*c* is an cross-sectional view along the section line aa (of FIG. 1*b*) of a conventional IDC employing the IDT of FIG. 1*a;*
Figure 2:
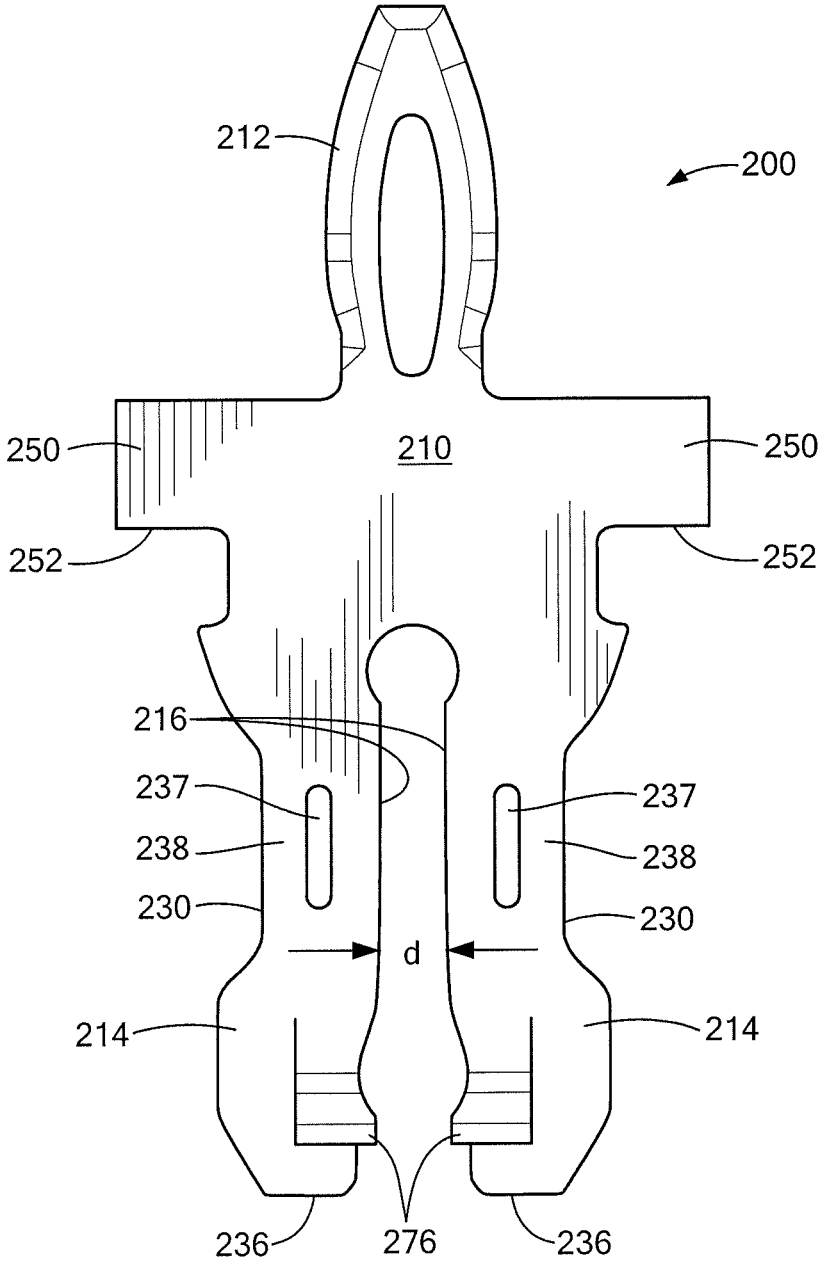
FIG. 2 is a side view of an IDT in accordance with the present invention.
Figure 3B:
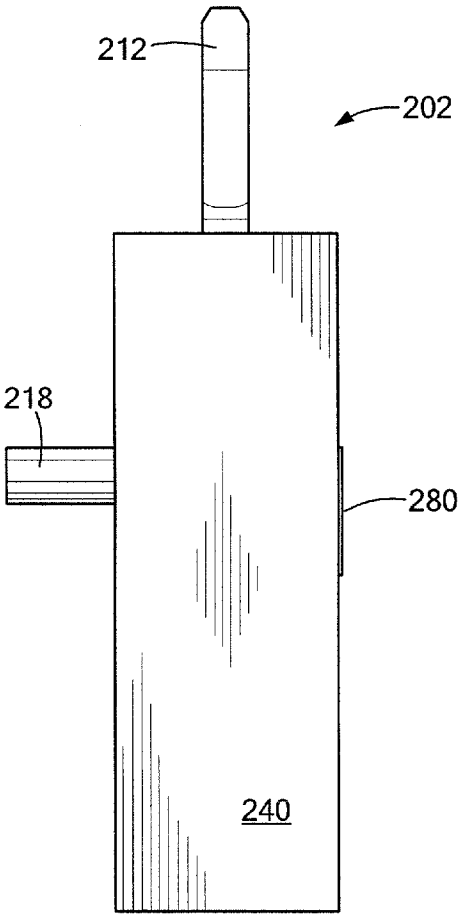
FIG. 3*b* is an end view of the IDC of FIG. 3*a* including the IDT of FIG. 2.
Figure 3A:
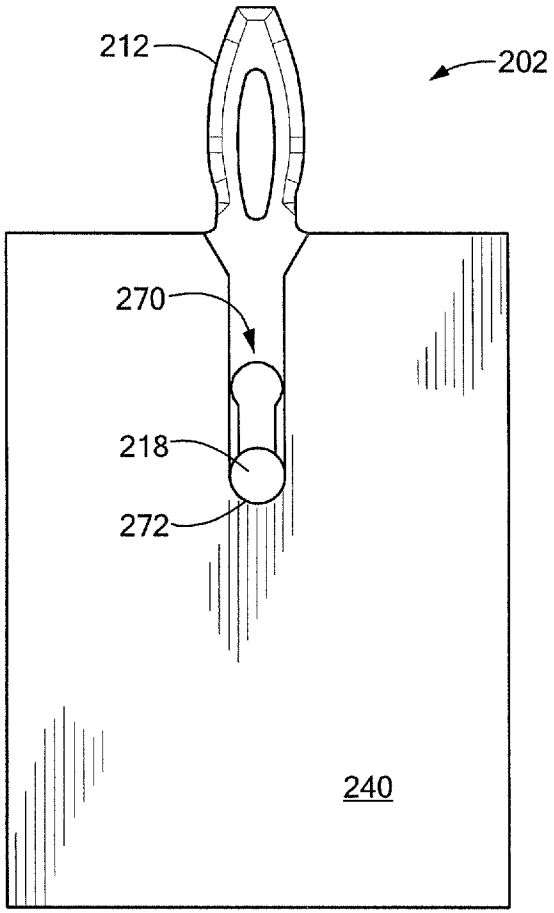
FIG. 3*a* is a side view of an IDC in accordance with the present invention that includes the IDT of FIG. 2.
Figure 4A:
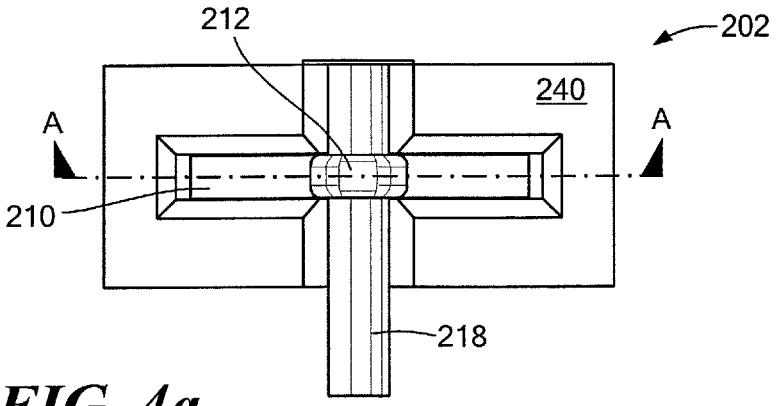
FIG. 4*a* is a top view of the IDC of FIGS. 3*a* and 3*b* including the IDT of FIG. 2.
Figure 4B:
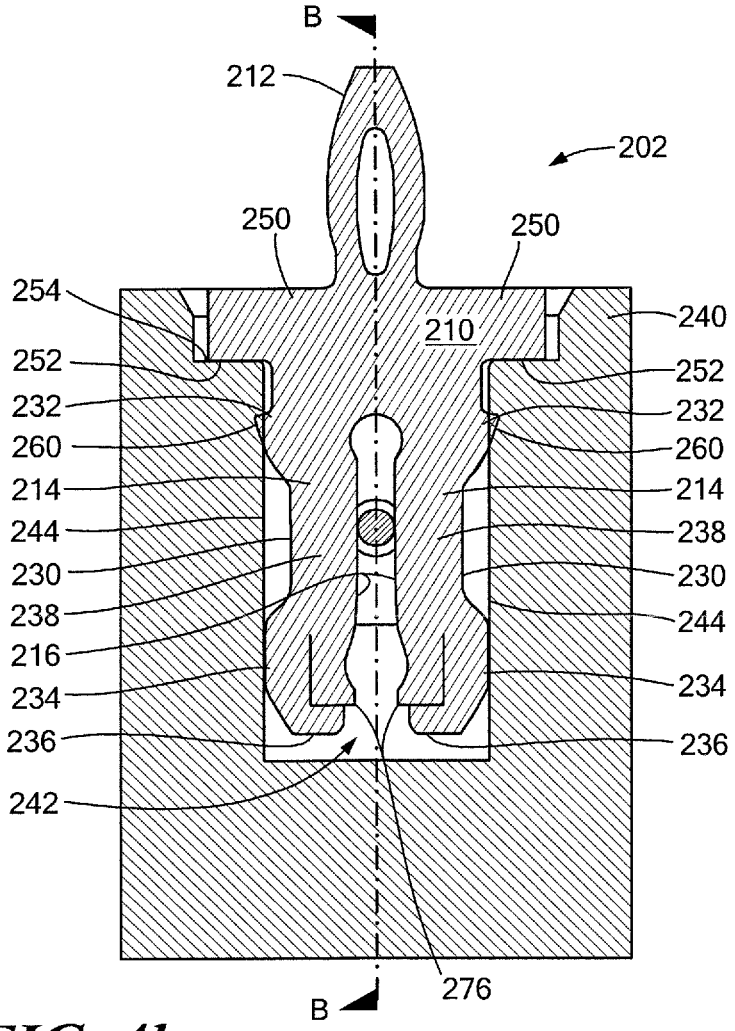
FIG. 4*b* is a cross-sectional view of the IDC of FIGS. 3*a* and 3*b* including the terminal of FIG. 2 through section AA of FIG. 4*a;*
Figure 4C:
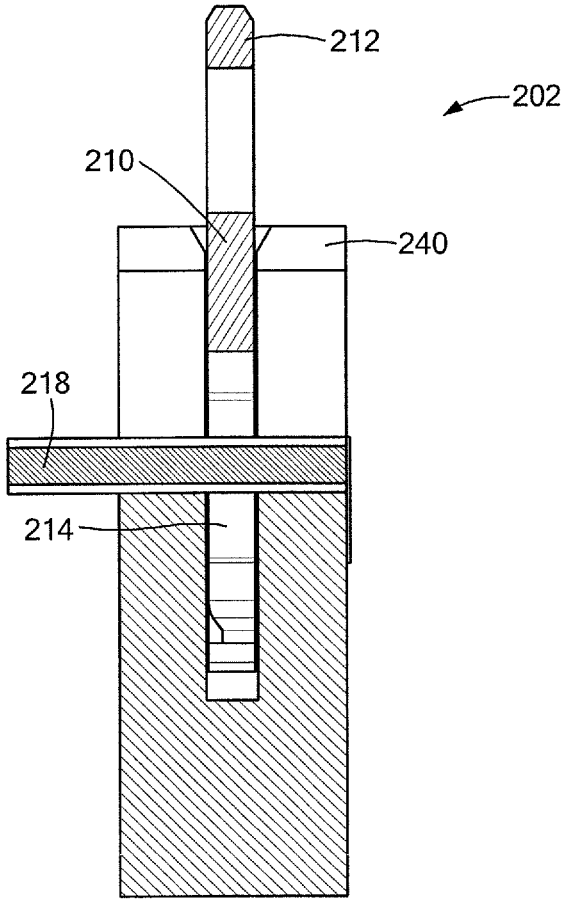
FIG. 4*c* is a cross sectional view of the IDC of FIG. 3*b* including the terminal of FIG. 2 through section BB of FIG. 4*b;*
Figure 5A:
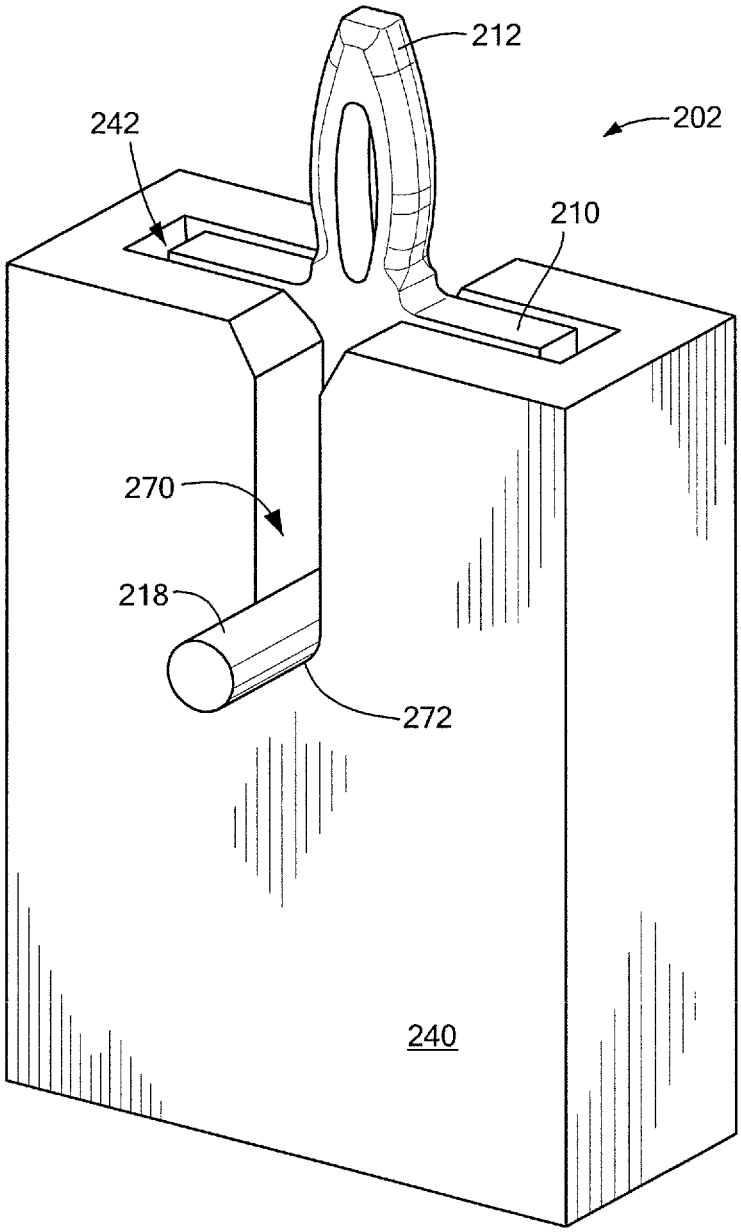
FIG. 5*a* is a perspective view of the IDC of FIGS. 3*a* and 3*b* including the IDT of FIG. 2.
Figure 5B:
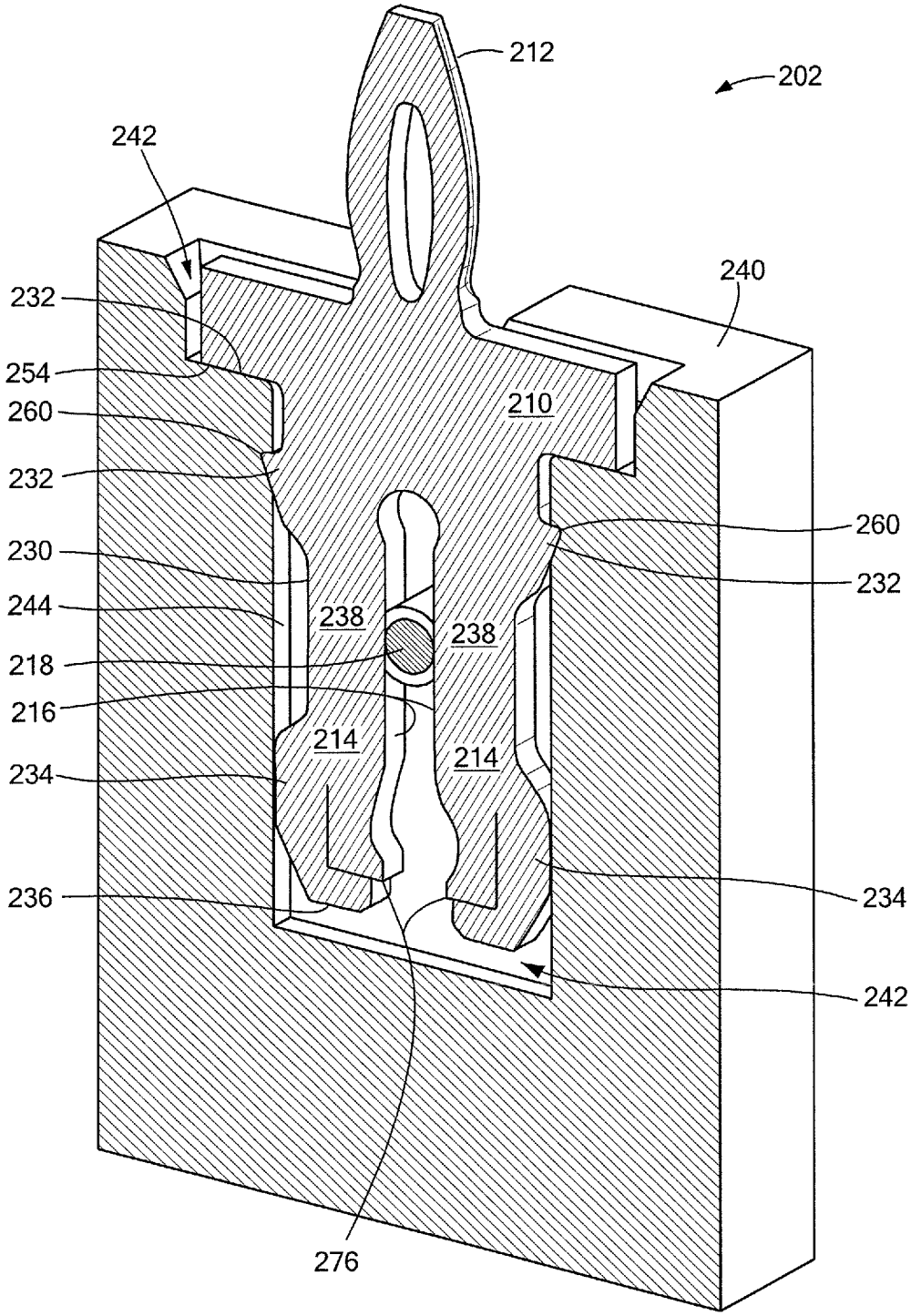
FIG. 5*b* is a cutaway perspective view of the IDC of FIGS. 3*a* and 3*b* including the terminal of FIG. 2.

As illustrated in FIG. 1*d*, conventional IDTs have a base portion, a contact portion that extends from one side of the base portion and a pair of spaced fingers that extend from the opposing side of the base portion.

The fingers have opposed inner edges and outer edges. The outer edge of each finger includes an anchor section proximal to the base portion. The anchor section includes a barb that engages the adjacent end wall and secures the IDT within housing. The outer edge of each finger is unconstrained between the anchor section and the end of the finger. Thus, insertion of a wire within the conventional IDT can cause the fingers to splay slightly outward resulting in non-normal forces on the wire once captured in the IDT. The non-normal forces exerted on the wire insertion of a wire in the low deflection IDT can result in wire movement away from the base portion as the fingers 102 splay slightly outward. Such movement can eventually lead to an unreliable connection which may be manifested in a higher resistance or intermittent electrical conductivity.

Finally, the conventional IDT has sharpened corners on inner edges and uneven opposed inner edges resulting from the metal stamping process used in their manufacture. The sharpened corners cut through the wire 104 insulation and form a small V groove within the wire. The engagement of the sharpened corners of conventional IDTs disadvantageously result in a small area contact with the wire and the uneven inner edges result in differing forces being exerted by the inner edge of the IDT on the wire. These factors can produce a connection that is intermittent and unreliable due to temperature cycling and/or variations.

Referring to FIGS. 2-5*b*, an improved IDT 200 and IDC 202 in accordance with the present invention is shown. The IDT 200 includes a base portion 210, at least one contact portion 212 extending from the base portion 210 in a first direction and a pair of opposed wire engaging fingers 214 extending from the base portion 210 in a second direction opposite from the first direction. The contact portion is a termination for making electrical contact with the insulation displacement terminal. The contact portion 212 may be a press fit terminal as illustrated or any other suitable termination for making electrical connection to the IDT 200.

The IDT 200 is formed as a single unitary piece of a spring based metallic alloy, such as by stamping. By way of example and not limitation, a CuNiSi alloy may be employed. The fingers 214 have inner edges 216 that are spaced apart by a distance "d" slightly less than the diameter of a wire 218 to be disposed between the fingers 214 of the IDT 200. Following the formation of the terminal, in another operation, the corners of the inner edges 216 are deburred, such as by chamfering or rounding the corners of the inner edges 216. Additionally, the inner edge is formed into a generally planar surface.

The outer edge 230 of each finger 214 has a first abutment section 232 proximal to the base portion 210 and a second abutment section 234 distal from the base portion 210 and near the end 236 of the respective finger 214. The first and second abutment sections 232, 234 abut the adjacent end wall and are constrained by the end wall against outward movement. The outer edges 230 of the fingers 214 are recessed from the outer edges of the first and second abutment sections 232, 234 so that the fingers 214 have a thinned resilient spring-like mid-section 238 between the first and second abutment sections 232, 234.

The IDT 200 is disposed within connector housing 240 and more specifically, within a terminal receiving slot 242 formed within the housing 240. When the IDT 200 is disposed within the terminal receiving slot 242, edges of the first and second abutment sections 232, 234 abut the end walls 244 defining the opposing ends of the terminal receiving slot 242.

The base portion 210 includes flanges 250 that extend outward of the fingers 214. The flanges 250 have a lower edge 252 that abuts a ledge 254 within the housing 240 to limit the insertion depth of the IDT 200 in the housing 240. The first abutment sections 232 include barbs 260 that deform and engage the end walls 244 of the terminal receiving slot 242 upon insertion of the IDT 200 into the terminal receiving slot 242 to secure the IDT 200 within the housing 240.

The housing 240 includes a U-shaped wire receiving slot 270 that extends generally through the housing 240 and that is sized to receive the wire 218. The wire may be a varnished or enameled magnet wire 218 for which the varnish or enamel provides an insulating coating. To secure the wire 218 within the IDC 200, the wire 218 is disposed at the bottom of the U-shaped wire receiving slot 270 such that the wire 218 is supported by shoulders 272 defining the end of the U-shaped wire receiving slot 270. The IDT 200 is then inserted into the terminal receiving slot 242, fingers first. The fingers 214 of the IDT 200 each include a scraper 276 located on the inner edge 216 of the fingers 214 distal from the base portion 210. As illustrated, the scrapers 276 have a generally right angled corner that is sufficiently sharp or abrasive to scrape the insulating coating or insulating cover from opposing sides of the wire 218 as the scrapers are urged past the wire 218 during insertion of the IDT 200 into the terminal receiving slot 242. The scrapers 276 on opposed fingers 214 have inner edges that are spaced from one another by a distance slightly less than the diameter of the wire to be used with the IDT 200. Thus, as the inner edges of the scrapers 276 pass over the wire 218 during the insertion of the IDT 200 into the terminal receiving slot 242, the scrapers 276 remove the insulating coating on the outer surface of the wire 218. The scrapers 276 may be formed as a generally right angled edge as illustrated or in any other suitable shape or surface configuration that serves to remove the insulation from the wire 218 as the scrapers 276 are urged over the wire 218.

Once the wire 218 is captured between the inner edges 216 of the opposed fingers 214, the mid-sections 238 of the fingers 214 apply a substantially normal force to the wire 218 due to the resilient spring-like mid-section 238 provided in the fingers 214. The generally normal forces applied by the spring-like mid-sections 238 serve to maintain a reliable electrical connection in the event of variations in mechanical dimensions of the housing or terminal due to temperature variations since the interconnection normal force is generally maintained by the spring action of the mid-section 238 of the fingers 214. Essentially, the mid-section 238 is a spring-like beam supported at either end by the first an second abutment sections when the IDT 200 is disposed in the terminal receiving slot 242.

The disclosed IDC 202 is suitable for power or signal applications. It is also noted that due to the resilience of the mid-section 238 of the fingers, the presently disclosed IDT allows for larger relaxation in the constrained materials without effecting the integrity of the electrical interconnection between the IDT and the wire 218 captured therein. Additionally, as a consequence of the resilient spring-like mid-sections 238 in the presently disclosed IDT 200, the IDT 200 can accommodate a larger range of wire sizes than can be accommodated in a traditional low deflection IDC.

When the IDT 200 is fully inserted within the terminal receiving slot 242 of the housing 240 with the lower edges of the flanges 250 of the base portion 210 abutting the ledges 254 formed within the housing 240, the wire 218 is captured between the inner edges 216 of the fingers 214. The inner edges 216 of the fingers 214 are generally planar along at least the portion of the inner edge of the fingers that make contact with the wire 218 when the IDT 200 is disposed within the terminal receiving slot 242. As a consequence, the fingers 214 make contact with the wire 218 over a larger area than is achieved with conventional IDTs allowing for higher current carrying capacities. A reliable conductive connection is thus provided between the inner edges 216 of the fingers 214 and the wire 218 captured therebetween.

A cover 280 is provided on one side of the housing 240 to prevent the conductive end of the wire 218 from being exposed. The cover 280 may be affixed to the side of the housing 240 as shown or alternatively, formed as an integral part of the housing 240.

The illustrated embodiment discussed above includes an outer edge that is recessed from the end walls between the first and second abutment sections to provide the spring-like mid-section 238 discussed above. It should be appreciated that the spring-like mid-section may alternatively be provided by providing one or more slots or openings 237 (FIG. 2) within the mid-section of each finger to reduce the material in the finger while having a generally planar outer edge extending between the first and second abutment sections. In this alternative embodiment, a resilient spring-like mid-section providing the benefits described herein may also be achieved.

The illustrated IDC includes a housing 240 with a single terminal receiving slot 242 that receives a single IDT 200. It should be appreciated that a housing may have a plurality of terminal receiving slots 242 that can accommodate a corresponding plurality of IDTs 200. Moreover, while a single contact portion 212 is illustrated, plural contact portions may be employed that are integrally formed with a single base portion 210 as a single piece unitary structure.

Additionally, though the use of the large deflection IDC with magnet wire having an enameled or varnished insulating cover is discussed herein, the presently disclosed IDC may also be employed with wires that are insulated with extruded insulating covers such as plastics, natural or synthetic rubbers, nylon or any other suitable insulating covers that may be removed via a scraper as describe herein.

It will be appreciated that modifications to and variations of the above-described IDT and IDC may made without departing from the inventive concepts disclosed herein. Accordingly, the invention is not to be viewed as limited except by the scope and spirit of the appended claims.

What is claimed is:

1. An insulation displacement terminal for mounting within a terminal receiving slot in a housing of an insulation displacement interconnection system, the housing having opposed spaced end walls, the insulation displacement terminal comprising:

a base portion having first and second opposing sides;

a contact portion extending from the first side of the base portion for making electrical contact with the insulation displacement terminal; and opposed fingers each extending from the second side of the base portion to a distal end, the opposed fingers having a length and having outer edges and opposed inner edges spaced from one another so as to make electrical contact with a wire disposed between the opposed inner edges, the outer edges of each finger including a first abutment section proximal to the base portion and a second abutment section adjacent the distal end of the finger respectively, the first and second abutment sections configured to abut an adjacent end wall of the terminal receiving slot when the insulation displacement terminal is disposed within the housing to constrain the outer edge of the respective finger against outward movement at the respective abutment sections, each finger having a resilient spring-like mid-section along at least a portion of the length of the finger between the first and second abutment sections to permit outward deformation of the inner edge of the finger upon disposal of a wire between the opposed spaced fingers adjacent the finger mid-sections, wherein each finger includes at least one opening within the mid-section to provide the resilient spring-like mid-section.

2. The insulation displacement terminal of claim 1 wherein a portion of the outer edge between the first and second abutment sections in inwardly recessed toward the inner edge such that each finger has a width that is narrower in the mid-section to provide a thinned resilient spring-like mid-section.

3. The insulation displacement terminal of claim 1 wherein the fingers have smooth corners along at least a wire contact area of the inner edges.

4. The insulation displacement terminal of claim 1 wherein the inner edges of opposed fingers are generally planar along at least a portion of the length of the fingers.

5. The insulation displacement terminal of claim 1 wherein the inner edges of each one of the opposed fingers includes a scraper member adjacent the end of the respective finger distal from the base portion, the scraper members having inner edges spaced apart by a distance slightly less than a diameter of a wire intended for use with the insulation displacement terminal.

6. The insulation displacement terminal of claim 1 wherein the first abutment sections includes an outwardly extending barb configured to engage the end walls of the slot to retain the terminal within the housing when the insulation displacement terminal is disposed therein.

7. The insulation displacement terminal of claim 1 wherein the base portion includes flanges extending outwardly of the fingers, the flanges having a lower edge configured to abut a ledge within the housing to define an insertion depth of the terminal when the terminal is inserted within the housing.

8. An insulation displacement connector comprising:

a housing having a terminal receiving slot extending into the housing from an open end of the housing, the terminal receiving slot having first opposed end walls spaced apart by a first distance; and an insulation displacement terminal disposed with the terminal receiving slot of the housing, the insulation displacement terminal including:

a base portion having first and second opposing sides;

a contact portion extending from the first side of the base portion; and a pair of opposed spaced fingers, each extending from the second side of the base portion to a distal end, the opposed fingers having a length and having outer edges and opposed inner edges spaced from one another so as to make electrical contact with a wire disposed between the opposed inner edges, the outer edges of each finger including a first abutment section proximal to the base portion and a second abutment section adjacent the distal end of the finger respectively, the first and second abutment sections configured to abut an adjacent one of the first opposed end walls when the insulation displacement terminal is disposed within the terminal receiving slot to constrain the outer edge of the respective finger against outward movement at the respective abutment sections, each finger having a resilient spring-like mid-section along at least a portion of the length of the finger between the first and second abutment sections to permit outward deformation of the inner edge of the finger upon disposal of a wire between the opposed spaced fingers adjacent the finger mid-sections, wherein each finger includes at least one opening within the mid-section to provide the resilient spring-like mid-section.

9. The insulation displacement connector of claim 8 wherein a portion of the outer edge between the first and second abutment sections in inwardly recessed toward the inner edge such that each finger has a width that is narrower in the mid-section to provide a thinned resilient spring-like mid-section.

10. The insulation displacement connector of claim 8 wherein the fingers have smooth corners along the inner edges.

11. The insulation displacement connector of claim 8 where the inner edges of the opposed fingers are substantially planar along a wire contact area.

12. The insulation displacement connector of claim 8 wherein the inner edges of opposed fingers each include a scraper member adjacent an end of the respective finger distal from the base portion, the scraper members having inner edges spaced from one another by a distance slightly less than a diameter of a wire to be disposed between the fingers.

13. The insulation displacement connector of claim 8 wherein the first abutment sections includes an outwardly extending barb engaging the end walls of the slot to retain the insulation displacement terminal within the housing.

14. The insulation displacement terminal of claim 8 wherein the terminal receiving slot includes opposed second end walls adjacent the open end, the second end walls spaced by a second distance greater that the first distance and outboard of the first end walls, the housing including a ledge extending between the first end walls and the adjacent second end wall;

the base portion including flanges extending outwardly of the fingers, the flanges each including a surface that abuts one of the ledges within the housing to limit an insertion depth of the insulation displacement terminal within the housing.

* * * * *